United States Patent [19]

Lehrter

[11] 4,091,535

[45] May 30, 1978

[54] SHINGLE STRIPPER

[75] Inventor: James F. Lehrter, Reading, Ohio

[73] Assignee: The Raymond Lee Organization, Inc., New York, N.Y. ; a part interest

[21] Appl. No.: 809,375

[22] Filed: Jun. 23, 1977

[51] Int. Cl.[2] ..... A47L 11/12; A47L 13/02

[52] U.S. Cl. ..... 30/169; 15/93 R; 299/37

[58] Field of Search ..... 30/169, 172, 216; 299/37, 39; 15/93 R

[56] References Cited

U.S. PATENT DOCUMENTS

| | | | |
|---|---|---|---|
| 3,251,629 | 5/1969 | Cawley | 299/37 |
| 3,663,061 | 5/1972 | Miller | 299/37 |
| 3,818,593 | 6/1974 | Oliverius | 30/169 |
| 4,009,908 | 3/1977 | Alinder | 30/169 X |
| 4,011,618 | 3/1977 | Martin | 15/93 R |

*Primary Examiner*—Jimmy C. Peters

*Attorney, Agent, or Firm*—Daniel Jay Tick

[57] ABSTRACT

A guide device removably affixed to a roof includes a cable extending between the ridge and the gutter edge of the roof. An internal combustion engine is mounted in a housing having an open forward end and a closed rear end. Two drive shafts are rotatably mounted in the housing and coupled to, and rotated by, the motor. A cable drum is affixed to, and rotatable with, a drive shaft, and has the cable of the guide device wound thereon in a manner whereby as the drive shaft rotates, the cable is wound on the drum and the housing moves up the roof from the gutter to the ridge. A clutch decouples the motor from the drive shaft when the housing reaches the guide device at the ridge. Cutters at the forward end in the housing are coupled to the motor and driven thereby for cutting the nails of shingles as the housing is moved up the roof whereby the severed shingles fall into the housing and accumulate at the rear end thereof. A trap at the rear end of the housing permits removal of the severed shingles therefrom.

2 Claims, 7 Drawing Figures

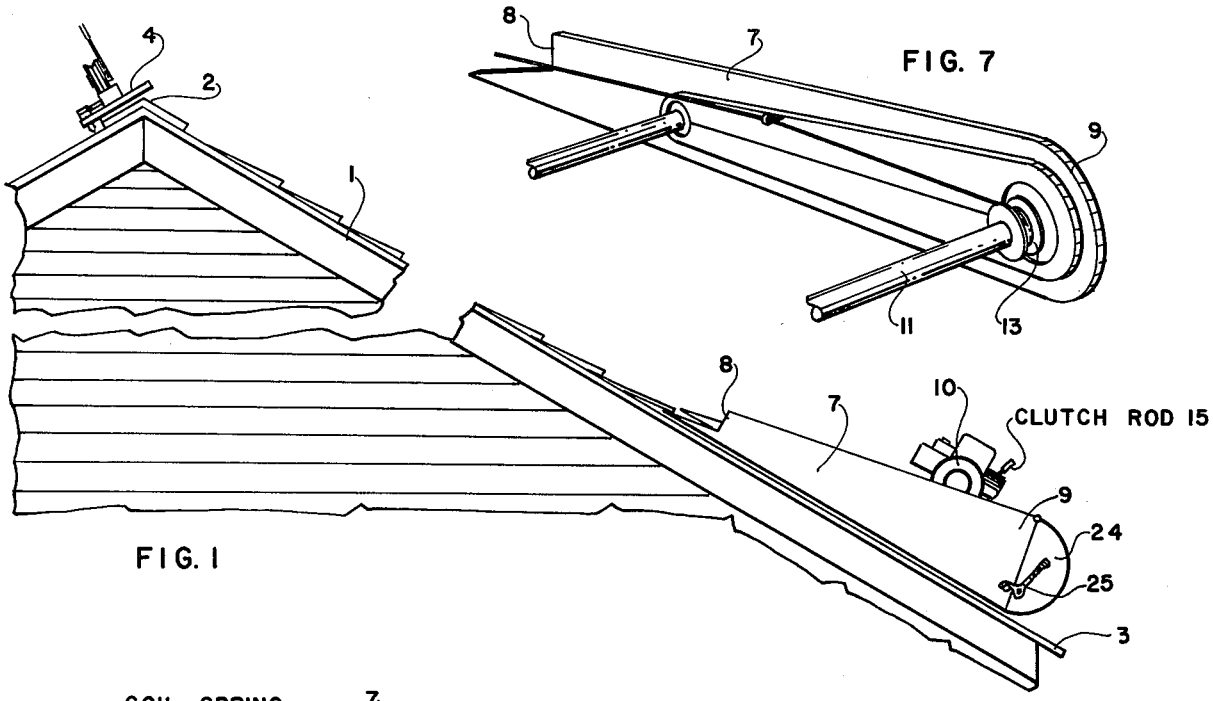
FIG. 7
FIG. 1
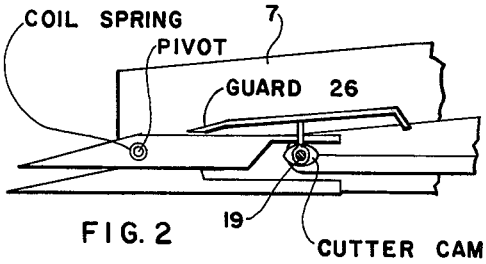
FIG. 2
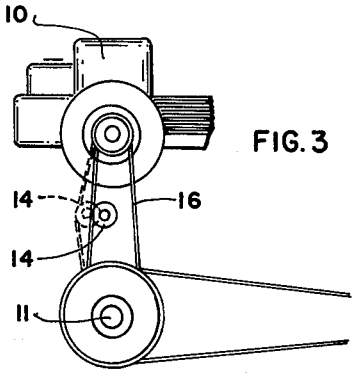
FIG. 3
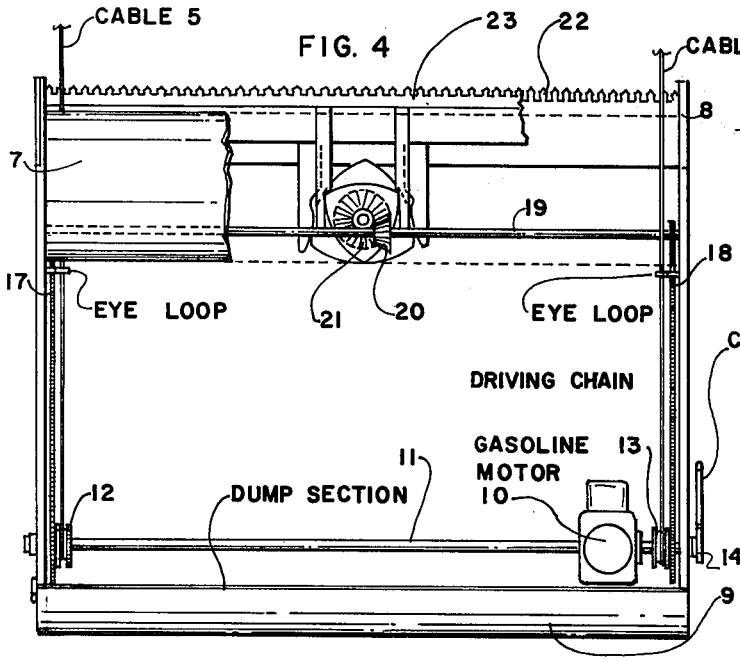
FIG. 4
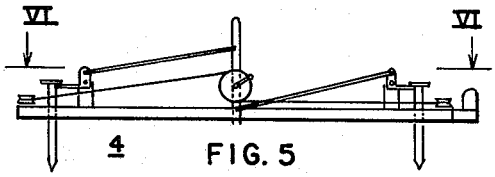
FIG. 5
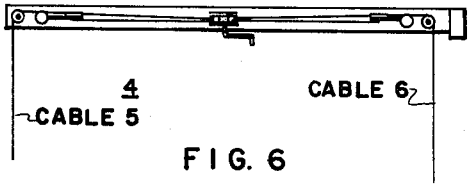
FIG. 6

SHINGLE STRIPPER

BACKGROUND OF THE INVENTION

The present invention relates to a shingle stripper. More particularly, the invention relates to a shingle stripper for stripping shingles off a roof having a ridge and a gutter edge.

Objects of the invention are to provide a shingle stripper of simple structure, which is inexpensive in manufacture, used with facility and convenience, and functions efficiently, effectively and reliably to remove shingles, and especially asphalt shingles, from a roof, essentially automatically.

BRIEF DESCRIPTION OF THE DRAWINGS

In order that the invention may be readily carried into effect, it will now be described with reference to the accompanying drawings, wherein:

FIG. 1 is a view of an embodiment of the shingle stripper of the invention in use;

FIG. 2 is a view of part of the shingle stripper of the invention;

FIG. 3 is a view of an embodiment of a clutch device of the shingle stripper of the invention;

FIG. 4 is a top plan view, on an enlarged scale, partly cut away, of the embodiment of FIG. 1;

FIG. 5 is a side view of an embodiment of the ridge cleat of the invention;

FIG. 6 is a view, taken along the lines VI—VI, of FIG. 5; and

FIG. 7 is a perspective view, on an enlarged scale, of one of the cable drums of the shingle stripper of the invention.

DETAILED DESCRIPTION OF THE INVENTION

The shingle stripper of the invention strips shingles off a roof 1 having a ridge 2 and a gutter edge 3, as shown in FIG. 1.

The shingle stripper of the invention comprises a ridge cleat 4, shown in FIGS. 1, 5 and 6, removably affixed to the roof 1. The ridge cleat 4 includes a pair of cables 5 and 6 extending between the ridge 2 and the gutter edge 3 of the roof. As shown in FIGS. 4 and 6, the cables 5 and 6 extend in spaced parallel relation from the ridge cleat at the ridge 2 to the gutter edge 3. The ridge cleat is essentially an anchor or pulley arrangement which enables the shingle stripper of the invention to pull itself up the roof, along the cables 5 and 6.

The shingle stripper of the invention comprises a housing 7 (FIGS. 1, 2, 4 and 7). The housing 7 has an open forward end 8 and a closed rear end 9 (FIGS. 1, 4 and 7).

An internal combustion engine or motor 10 of any suitable type is mounted in the housing 7, as shown in FIGS. 1 and 4. A pair of shafts 11 and 19 (FIGS. 2 to 4 and 7) are mounted in the housing 7 and coupled to, and rotated by, the motor 10.

Two cable drums 12 and 13 (FIG. 4) are affixed to, and rotatable with, the drive shaft 11. The cable drum 12 has the cable 5 of the ridge cleat wound thereon and the cable drum 13 has the cable 6 of the ridge cleat wound thereon in a manner whereby as the drive shaft 11 rotates, the cable is wound on the cable drums and the housing moves up the roof 1 from the gutter edge 3 to the ridge 2.

A clutch device 14 (FIGS. 3 and 4) is provided for decoupling the motor 10 from the drive shaft 11 when the housing 7 reaches the ridge cleat 4 at the ridge 2 of the roof. This is desired to prevent the shingle stripper from moving beyond the ridge of the roof, since once a furrow or column of shingles has been cleared, the shingle stripper must be moved to a next-adjacent area to clear the next-adjacent columns of shingles. The clutch device 14 includes a clutch rod 15 (FIGS. 1 and 4). When the clutch is in engagement, so that the motor 10 drives the drive shaft 11, said clutch is in its position shown in broken lines in FIG. 3. However, when the housing 7 reaches the ridge 2, the clutch rod 15 is abutted by the clutch stop 4 to move the clutch device 14 into its decoupling position, shown by solid lines in FIG. 3, in which the drive tension is removed from the drive belt 16 (FIG. 3) so that the motor 10 no longer drives the drive shaft 11.

A cutting device is provided in the housing 7 at the forward open end 8 thereof and is coupled to the motor 10 and driven thereby via a pair of driving chains 17 and 18, a driven shaft 19 and a pair of bevel gears 20 and 21, in the housing 7, as shown in FIG. 4. The cutting device cuts the nails of the shingles as the housing is moved up the roof 1. As the nails are cut, the severed shingles fall into the housing 7 and accumulate at the rear end 9 thereof.

The cutting device comprises a first plurality of spaced cutting teeth 22 reciprocally mounted at the open mouth 8 of the forward end of the housing 7 and a second plurality of spaced cutting teeth 23 reciprocally mounted in the housing 7 and coupled to the motor 10 via the driving chains 17 and 18, the driven shaft 19 and the bevel gears 20 and 21 to alternately provide gaps and close said gaps with the first plurality of cutting teeth 22.

The bevel gears 20 and 21 turn the double lobe cam which causes the reciprocating action of the teeth.

A trap device 24 is provided in the housing 7 at the rear end 9 thereof, as shown in FIG. 1, and is openable for removing severed shingles from the housing. The trap device is removably latched to the housing via a latch device 25, as shown in FIG. 1.

Side cutters are coupled to the motor for cutting the shingles to the proper width so that they may enter the housing.

A guard or safety shield 26 (FIG. 2) is provided for the bevel gears 20 and 21 and side cutter cams to prevent severed shingles from becoming intermeshed therewith and thereby disrupting the operation of the device.

While the invention has been described by means of a specific example and in a specific embodiment, I do not wish to be limited thereto, for obvious modifications will occur to those skilled in the art without departing from the spirit and scope of the invention.

I claim:

1. A shingle stripper for stripping shingles off a roof having a ridge and a gutter edge, said shingle stripper comprising guide means removably affixed to a roof and including a cable extending between the ridge and the gutter edge of the roof;

a housing having an open forward end and a closed rear end;

an internal combustion motor mounted in the housing;

a pair of shafts rotatably mounted in the housing and coupled to and rotated by the motor;

a cable drum affixed to and rotatable with the drive shaft having the cable of the guide means wound thereon in a manner whereby as the drive shaft rotates the cable is wound on the cable drum and the housing moves up the roof from the gutter edge to the ridge;

clutch means for decoupling the motor from the drive shaft when the housing reaches the guide means at the ridge;

cutting means in the housing at the forward end thereof coupled to the motor and driven thereby for cutting the nails of the shingles as the housing is moved up the roof whereby the severed shingles fall into the housing and accumulate at the rear end thereof; and trap means in the housing at the rear end thereof for removing severed shingles therefrom.

2. A shingle stripper as claimed in claim 1, wherein the cutting means comprises a first plurality of spaced cutting teeth and a second plurality of spaced cutting teeth reciprocally moved relative to each other by the motor to alternately provide gaps and close said gaps with said first plurality of cutting teeth thereby severing nails in the gaps.

* * * * *